US008313231B2

(12) United States Patent
Kwon et al.

(10) Patent No.: US 8,313,231 B2
(45) Date of Patent: Nov. 20, 2012

(54) DROPLET MIXING APPARATUS AND DROPLET MIXING METHOD

(75) Inventors: Tai-Hun Kwon, Pohang (KR); Sung-Jae Park, Incheon (KR)

(73) Assignee: Postech Academy-Industry Foundation, Pohang (KR)

( * ) Notice: Subject to any disclaimer, the term of this patent is extended or adjusted under 35 U.S.C. 154(b) by 1114 days.

(21) Appl. No.: 12/161,771

(22) PCT Filed: Mar. 22, 2007

(86) PCT No.: PCT/KR2007/001393

§ 371 (c)(1),
(2), (4) Date: Jul. 22, 2008

(87) PCT Pub. No.: WO2004/103566

PCT Pub. Date: Dec. 2, 2004

(65) Prior Publication Data

US 2010/0225685 A1 Sep. 9, 2010

(30) Foreign Application Priority Data

Nov. 7, 2006 (KR) ..... 10-2006-0109456
Feb. 12, 2007 (KR) ..... 10-2007-0014354

(51) Int. Cl.
*B01F 15/02* (2006.01)

(52) U.S. Cl. ..... 366/160.1; 366/173.1; 366/182.1; 366/182.4

(58) Field of Classification Search ..... 366/137.1, 366/162.4, 167.1, 173.1, 177.1, 182.1, 182.4, 366/160.1
See application file for complete search history.

(56) References Cited

U.S. PATENT DOCUMENTS 2,073,652 A * 3/1937 Robb ..... 366/14
3,161,322 A * 12/1964 Stone ..... 222/5
3,208,823 A * 9/1965 Austin et al. ..... 524/493
3,424,386 A * 1/1969 Maasberg et al. ..... 239/427.3
3,884,388 A * 5/1975 Holcomb ..... 222/132
4,126,398 A * 11/1978 Phillips et al. ..... 366/76.6
4,270,673 A 6/1981 Rodth
4,473,531 A * 9/1984 Macosko et al. ..... 422/133
(Continued)

FOREIGN PATENT DOCUMENTS

FR 2 503 102 10/1982
(Continued)

OTHER PUBLICATIONS

International Search Report and Written Opinion for PCT/KR2007/001393 dated Jul. 12, 2007.

(Continued)

*Primary Examiner* — Tony G Soohoo
(74) *Attorney, Agent, or Firm* — Marshall, Gerstein & Borun LLP

(57) ABSTRACT

A droplet mixing apparatus can be applied for use with a variety of liquids, can provide a mixing speed of hundreds of nl/s by adjusting an opening/closing time of a solenoid valve, can effectively mix droplets, and can reduce a reaction time when applied to clinical appliances that utilize expensive liquids. The droplet mixing apparatus includes a plurality of pressure containers storing liquids that are to be dispensed, a plurality of solenoid valves that are respectively connected to the pressure containers to dispense the liquids fed from the pressure containers into a mixing container, and a control unit that controls the solenoid valves such that the solenoid valves are either simultaneously opened or alternately opened and closed.

14 Claims, 18 Drawing Sheets

U.S. PATENT DOCUMENTS

| | | | | |
|---|---|---|---|---|
| 4,568,003 | A * | 2/1986 | Sperry et al. | 222/145.5 |
| 5,011,293 | A * | 4/1991 | Roop et al. | 366/162.4 |
| 5,186,905 | A * | 2/1993 | Bertram et al. | 422/133 |
| 5,269,827 | A * | 12/1993 | Lenke et al. | 65/178 |
| 5,333,760 | A | 8/1994 | Simmen | |
| 6,051,630 | A * | 4/2000 | Serafin et al. | 523/315 |
| 6,200,013 | B1 * | 3/2001 | Takeuchi et al. | 366/162.4 |
| 6,227,694 | B1 * | 5/2001 | Mitake et al. | 366/162.4 |
| 6,322,193 | B1 * | 11/2001 | Lian et al. | 347/19 |
| 6,540,715 | B1 * | 4/2003 | Kuhn et al. | 604/82 |
| 6,719,211 | B2 | 4/2004 | Takeuchi et al. | |
| 6,896,401 | B2 * | 5/2005 | Wolfert et al. | 366/162.4 |
| 7,329,038 | B2 * | 2/2008 | Hashiba | 366/101 |
| 2003/0227820 | A1 * | 12/2003 | Parrent | 366/162.4 |
| 2004/0094418 | A1 | 5/2004 | Cox et al. | |
| 2004/0240311 | A1 * | 12/2004 | Hashiba | 366/101 |
| 2005/0014247 | A1 | 1/2005 | Cabrera et al. | |
| 2006/0171850 | A1 * | 8/2006 | Waterbury et al. | 422/100 |
| 2009/0123385 | A1 * | 5/2009 | Bohmer et al. | 424/9.52 |
| 2009/0170729 | A1 | 7/2009 | Cabrera et al. | |
| 2010/0225685 | A1 * | 9/2010 | Kwon et al. | 347/9 |

FOREIGN PATENT DOCUMENTS

| | | | |
|---|---|---|---|
| JP | 63-143930 | A | 6/1988 |
| JP | 8-505110 | T | 6/1996 |
| JP | 10-192662 | A | 7/1998 |
| JP | 11-262644 | A | 9/1999 |
| JP | 2000-108343 | A | 4/2000 |
| JP | 2002-139370 | A | 5/2002 |
| JP | 2003217842 | | 7/2003 |
| JP | 3974531 | T | 10/2004 |
| JP | 2004-534242 | T | 11/2004 |
| JP | 2006-281139 | A | 10/2006 |
| WO | WO-2004/103586 | A1 | 12/2004 |

OTHER PUBLICATIONS

Park et al., "A Mixing Method by Dispensing Nanoliter Droplets Controlled by High Speed Solenoid Valves (MDNS)," *Proceedings of the KSME 2006 Fall Annual Meeting*, Muju Resort in Muju, Jeonlabuk-do, pp. 2088-2093 (2006).

* cited by examiner

DROPLET MIXING APPARATUS AND DROPLET MIXING METHOD

TECHNICAL FIELD

The present invention relates to a droplet mixing apparatus and a droplet mixing method. More particularly, the present invention relates to a droplet mixing apparatus for mixing droplets using a solenoid valve or a commercialized inkjet nozzle, and to a droplet mixing method.

BACKGROUND ART

Dispensers for dispensing droplets are generally classified into a syringe driven-type dispenser, a solenoid valve-type dispenser, and an inkjet nozzle-type dispenser using a piezoelectric material or thermal deformation.

The syringe driven-type dispenser may dispense a droplet amount of 1 nl at a time. However, it is difficult to perform non-contact dispensing with this type of dispenser. Therefore, when the syringe driven-type dispenser is used for mixing droplets, it may be easily contaminated. Further, since a minimum dispensing amount of the syringe driven-type dispenser is greater than minimum dispensing amounts of the other types of dispensers, the syringe driven-type dispenser is limited in its applications.

In contrast, the solenoid valve-type dispenser is configured to be capable of performing non-contact dispensing. However, the solenoid valve-type dispenser has a minimum dispensing amount that is several nl greater than that of the inkjet nozzle-type dispenser.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide a droplet mixing apparatus and a droplet mixing method that can be applied for use with a variety of liquids, provide a mixing speed of hundreds nl/s by adjusting an opening/closing time of a solenoid valve, effectively mix droplets, and reduce a reaction time when applied to clinical appliances that utilize expensive liquids.

Technical Solution

In an exemplary embodiment of the present invention, a droplet mixing apparatus includes a plurality of pressure containers storing liquids that are to be dispensed, a plurality of solenoid valves that are respectively connected to the pressure containers to dispense the liquids fed from the pressure containers into a mixing container, and a control unit that controls the solenoid valves such that the solenoid valves are either simultaneously opened or alternately opened and closed.

Each of the solenoid valves may be provided at an extreme end with a nozzle, and the nozzles may be disposed above the mixing container in an inclined state.

The solenoid valves may include a first solenoid valve disposed above a first side of the mixing container and a second solenoid valve disposed opposing the first solenoid valve above a second side of the mixing container.

A first straight line extending from a first nozzle provided on the first solenoid valve and a second straight line extending from a second nozzle provided on the second solenoid valve may meet each other at a point located right above the mixing container.

Alternatively, a first straight line extending from a first nozzle provided on the first solenoid valve and a second straight line extending from a second nozzle provided on the second solenoid valve may meet the mixing container at points located therein.

The droplet mixing apparatus may further include pressure regulators that are respectively connected to the pressure containers and air compressors that are respectively connected to the pressure regulators.

In another exemplary embodiment of the present invention, a droplet mixing method includes feeding liquids respectively stored in a plurality of pressure containers to respective solenoid valves, and controlling the solenoid valves such that the solenoid valves are either simultaneously opened or alternately opened and closed to dispense the liquids into a mixing container.

The controlling of the solenoid valves may include controlling the solenoid valves such that the solenoid valves are simultaneously opened, and mixing droplets of the liquids dispensed through nozzles of the respective solenoid valves with each other by allowing the droplets to collide with each other at a point above the mixing container.

The liquids may include a first liquid and a second liquid, the solenoid valves may include a first solenoid valve for dispensing the first liquid and a second solenoid valve for dispensing the second liquid, and the first and second solenoid valves may be respectively provided at respective extreme ends with first and second nozzles. At this point, the controlling of the solenoid valves may include simultaneously opening the first and second solenoid valves, and the mixing of the droplets may include mixing first and second droplets of the respective first and second liquids dispensed through the respective first and second nozzles of the respective first and second solenoid valves with each other by allowing the first and second droplets to collide with each other at a point above the mixing container.

The controlling of the solenoid valves may include determining a mixture ratio of a mixed liquid formed by the first and second liquids by closing the first and second solenoid valves one after the other.

Alternatively, the controlling of the solenoid valves may include controlling the solenoid valves such that the solenoid valves are alternately opened, and mixing droplets of the liquids dispensed through nozzles of the respective solenoid valves with a mixed liquid in the mixing container by allowing the droplets to alternately collide with the mixed liquid in the mixing container.

In addition, the liquids may include a first liquid and a second liquid, the solenoid valves may include a first solenoid valve for dispensing the first liquid and a second solenoid valve for dispensing the second liquid, and the first and second solenoid valves may be respectively provided at respective extreme ends with first and second nozzles. At this point, the controlling of the solenoid valves may include alternately opening the first and second solenoid valves, and the mixing of the droplets may include mixing first and second droplets of the respective first and second liquids dispensed through the respective first and second nozzles of the respective first and second solenoid valves with a mixed liquid in the container by allowing the first and second droplets to alternately collide with the mixed liquid.

In addition, the controlling of the solenoid valves may include determining a mixture ratio of a mixed liquid formed by the first and second liquids by closing the first and second solenoid valves one after the other.

In still another exemplary embodiment of the present invention, a droplet mixing apparatus includes a plurality of dispensers for storing and feeding respective liquids, a plurality of inkjet nozzles that are respectively connected to the dispensers to dispense the liquids fed from the respective dispensers into a mixing container, and a control unit that controls the inkjet nozzles such that the inkjet nozzles are simultaneously or alternately driven.

The inkjet nozzles may be disposed above the mixing container in an inclined state.

The inkjet nozzles may include a first inkjet nozzle disposed above a first side of the mixing container and a second inkjet nozzle disposed opposing the first solenoid valve above a second side of the mixing container.

A first straight line extending from a first inkjet nozzle and a second straight line extending from a second inkjet nozzle may meet each other at a point located right above the mixing container.

Alternatively, a first straight line extending from a first inkjet nozzle and a second straight line extending from a second inkjet nozzle may meet the mixing container at points located therein.

In still yet another exemplary embodiment of the present invention, a droplet mixing method includes feeding liquids respectively stored in a plurality of dispensers to respective inkjet nozzles, and controlling the inkjet nozzles such that the inkjet nozzles are simultaneously or alternately driven by controlling driving voltages of the respective inkjet nozzles and frequencies of the respective inkjet nozzles to thereby dispense the liquids into a mixing container.

The controlling of the inkjet nozzles includes simultaneously driving the inkjet nozzles, and mixing droplets of the liquids dispensed through the respective first and second inkjet nozzles with each other by allowing the droplets to collide with each other at a point above the mixing container.

The liquids may include a first liquid and a second liquid, and the inkjet nozzles may include a first inkjet nozzle for dispensing the first liquid and a second inkjet nozzle for dispensing the second liquid. At this point, the simultaneous driving of the inkjet nozzles may include simultaneously driving the first and second inkjet nozzles, and the mixing of the droplets may include mixing first and second droplets of the respective first and second liquids dispensed through the respective first and second inkjet nozzles with each other by allowing the first and second droplets to collide with each other at a point above the mixing container.

The simultaneous driving of the inkjet nozzles may include determining a mixture ratio of a mixed liquid formed by the first and second liquids by differing frequencies of the driving voltages of the respective first and second inkjet nozzles.

Alternatively, the controlling of the inkjet nozzles may include alternately driving the inkjet nozzles, and mixing droplets of the liquids dispensed through the respective first and second inkjet nozzles with each other by allowing the droplets to alternately collide with a mixed liquid in the mixing container.

In addition, the liquids may include a first liquid and a second liquid, and the inkjet nozzles may include a first inkjet nozzle for dispensing the first liquid and a second inkjet nozzle for dispensing the second liquid. At this point, the alternate driving of the inkjet nozzles may include alternately driving the first and second inkjet nozzles, and the mixing of the droplets may include mixing first and second droplets of the respective first and second liquids dispensed through the respective first and second inkjet nozzles with each other by allowing the first and second droplets to collide with a mixed liquid in the mixing container.

The alternate driving of the inkjet nozzles may include determining a mixture ratio of a mixed liquid formed by the first and second liquids by differing frequencies of the driving voltages of the respective first and second inkjet nozzles.

Advantageous Effects

As described above, according to one exemplary embodiment of the present invention, by simultaneously or alternately opening a plurality of solenoid valves respectively connected to pressure containers, the liquids can be dispensed through nozzles provided on the respective solenoid valves, thereby effectively forming a mixed liquid. In this case, by controlling opening durations of the solenoid valves, the mixing speed can be improved and the mixture ratio of the liquids can be adjusted. Further, when the embodiment is applied to clinical appliances that utilize expensive liquids, the reaction time can be effectively reduced.

According to another exemplary embodiment of the present invention, by simultaneously or alternately opening a plurality of inkjet nozzles, the liquids can be dispensed through the nozzles, thereby effectively forming a mixed liquid. In this case, by controlling driving voltages and frequencies of the inkjet nozzles, the mixing speed can be improved and the mixture ratio of the liquids can be adjusted.

BEST MODE

The present invention will be described more fully hereinafter with reference to the accompanying drawings, in which exemplary embodiments of the invention are shown. The invention may, however, be embodied in many different forms and should not be construed as being limited to the exemplary embodiments set forth herein; rather, these embodiments are provided so that this disclosure will be thorough and complete, and will fully convey the concept of the invention to those skilled in the art. In the accompanying drawings, a description of parts that are not related to the present invention is omitted for the sake of simplicity, and the same reference numbers will be used to refer to the same or like parts.

Figure 1:
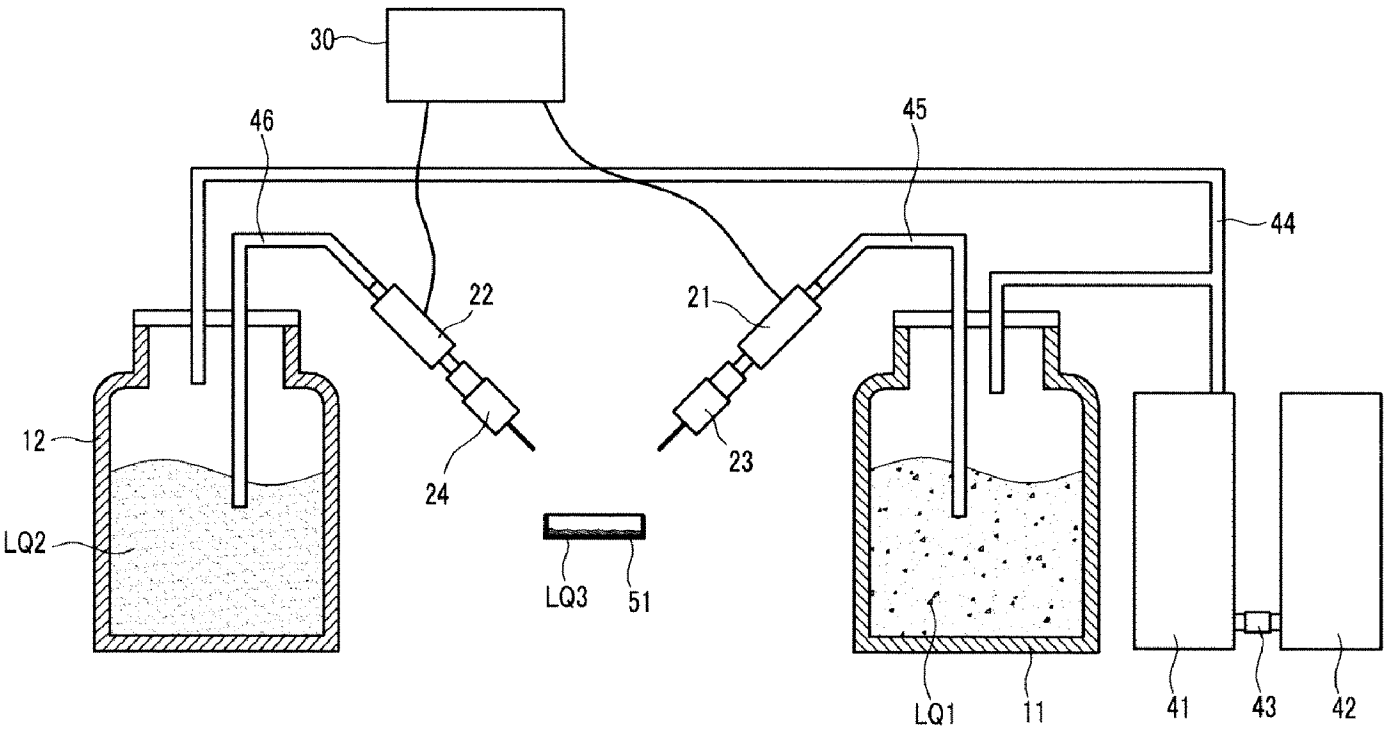
FIG. 1 is a schematic diagram of a droplet mixing apparatus according to a first exemplary embodiment of the present invention.
Figure 2:
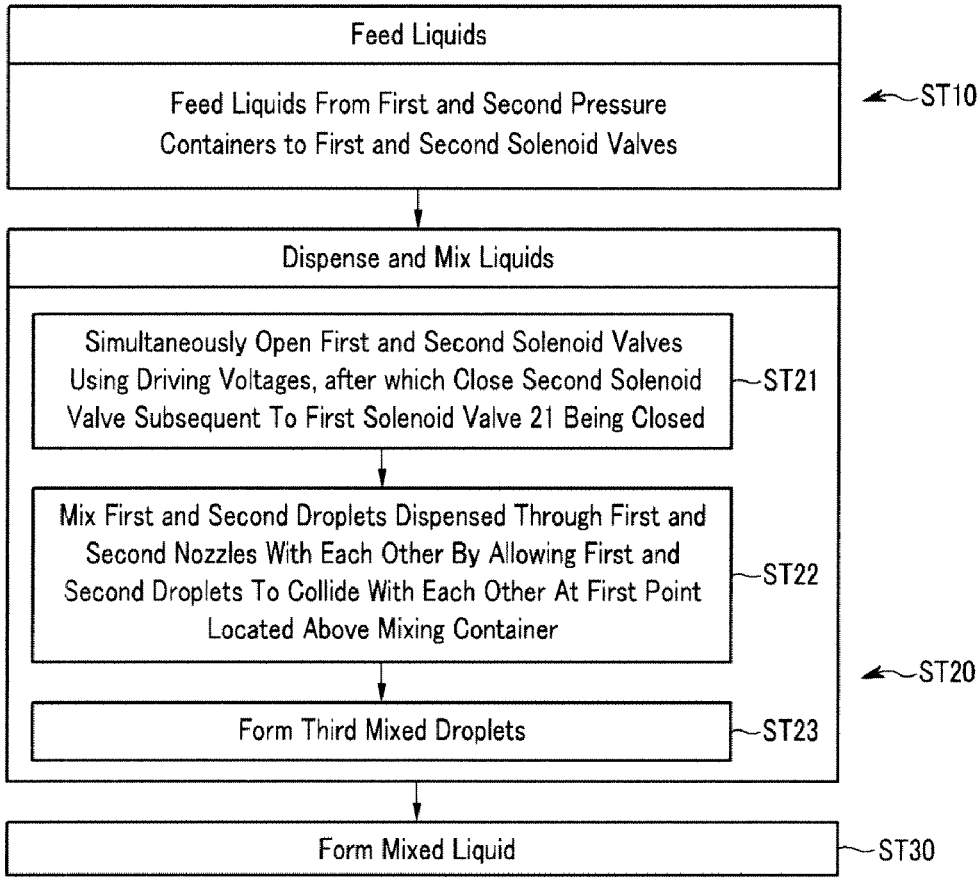
FIG. 2 is a flowchart illustrating a droplet mixing method according to a first exemplary embodiment of the present invention.

FIG. 1 is a schematic diagram of a droplet mixing apparatus according to a first exemplary embodiment of the present invention. Referring to FIG. 1, a droplet mixing apparatus of the present exemplary embodiment is configured to quickly mix a variety of different types of liquid with each other. For simplicity, the droplet mixing apparatus of this embodiment is designed to mix two different types of liquids (hereinafter, referred to as "first and second liquids LQ1 and LQ2").

The droplet mixing apparatus includes a plurality of pressure containers (e.g., first and second containers 11 and 12), a plurality of solenoid valves (e.g., first and second solenoid valves 21 and 22), and a control unit 30. The droplet mixing apparatus further includes a pressure regulator 41 and an air compressor 42.

The air compressor 42 generates compressed air and supplies the compressed air through an outlet thereof. The pressure regulator 41 is connected to a first line 43 of the air compressor 42 and regulates the compressed air so that the compressed air is maintained at a constant pressure.

The first and second pressure containers 11 and 12 respectively store the first and second liquids LQ1 and LQ2. The first and second pressure containers 11 and 12 are connected to the pressure regulator 41 through a second line 44. As a result of the regulation by the pressure regulator 41, internal pressures of the first and second pressure containers 11 and 12 are constantly maintained. The first and second liquids LQ1 and LQ2 are respectively fed to the solenoid valves 21 and 22 by the internal pressures of the respective first and second pressure containers 11 and 12.

To this end, the first and second solenoid valves 21 and 22 are respectively connected to the first and second pressure containers 11 and 12 through respective third and fourth lines 45 and 46. Therefore, the liquids LQ1 and LQ2 respectively stored in the first and second pressure containers 11 and 12 are respectively fed to the first and second solenoid valves 21 and 22 through the third and fourth lines 45 and 46, respectively.

The first and second solenoid valves 21 and 22 are respectively provided with first and second nozzles 23 and 24 to respectively dispense the first and second liquids LQ1 and LQ2. The first and second nozzles 23 and 24 are oriented toward a mixing container 51. The mixing container 51 stores a mixed liquid LQ3 that is a mixture of the first and second liquids LQ1 and LQ2.

The first and second solenoid valves 21 and 22 are disposed above the mixing container 51 in an inclined state. Therefore, the first solenoid valve 21 and the first nozzle 23 form a first extension line EL1 and the second solenoid valve 22 and the second nozzle 24 form a second extension line EL2 (see FIG. 3).

The first and second solenoid valves 21 and 22 are disposed opposing to each other above the mixing container 51. That is, when viewed from above (i.e., in a top plan view), the first and second solenoid valves 21 and 22 are arranged at an angle of 180° relative to each other. As the first and second solenoid valves 21 and 22 are symmetrically arranged, first droplets DL1 and second droplets DL2 (see FIG. 3) of the respective first and second liquids LQ1 and LQ2 that are respectively dispensed through the first and second nozzles 23 and 24 can be more uniformly mixed with each other. When the number of the solenoid valves is two as in the above, the angle between them is 180°. When the number of the solenoid valves is three, four, or more, the angle is 120°, 90°, or less. Stated differently, the solenoid valves may be arranged such that the same angle is formed between any two adjacent solenoid valves.

Figure 3:
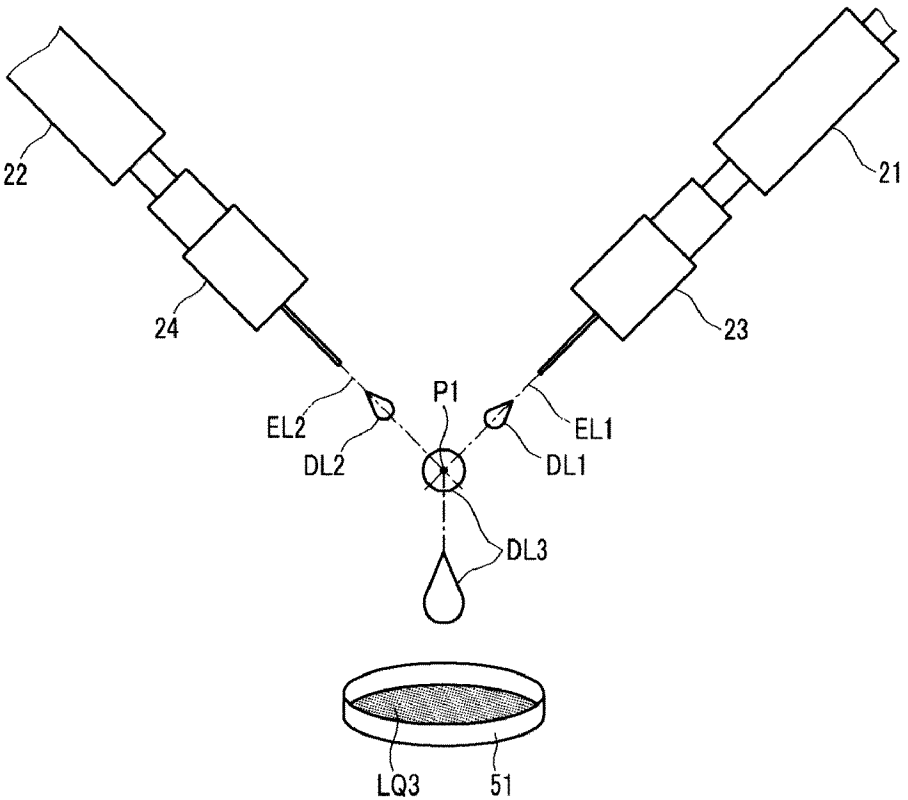
FIG. 3 is a view illustrating a state where droplets are mixed through collision with each other by being simultaneously dispensed according to the droplet mixing method of the first exemplary embodiment of the present invention.

Referring to FIG. 3, the first and second extension lines EL1 and EL2 of the respective first and second nozzles 23 and 24 meet each other at a first point P1 formed directly above the mixing container 51. Accordingly, when the first and second solenoid valves 21 and 22 are controlled to be simultaneously opened, the first droplets DL1 and the second droplets DL2 that are respectively dispensed through the first and second nozzles 23 and 24 collide with each other at the first point P1 to form third mixed droplets DL3.

By kinetic energy generated by the collision between the droplets, the first and second droplets DL1 and DL2 are mixed with each other while forming the third mixed droplets DL3. Subsequently, the third mixed droplets DL3 fall to the mixing container 51 by gravity so that the mixing is secondarily realized to thereby form the mixed liquid LQ3.

The first and second solenoid valves 21 and 22 may be controlled to be simultaneously opened and closed. In this case, the first and second liquids LQ1 and LQ2 form the mixed liquid LQ3 in such a manner that the first and second liquids LQ1 and LQ2 are mixed with each other in a ratio of 1:1.

Figure 4:
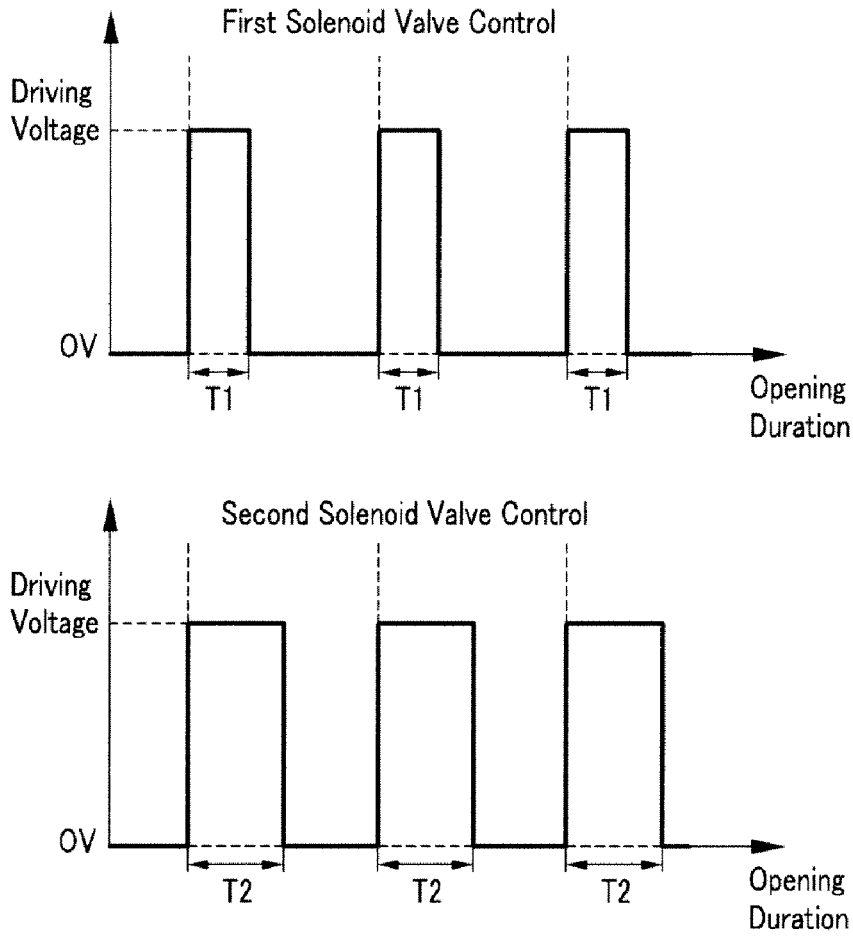
FIG. 4 is a time chart for driving solenoid valves such that droplets are mixed through collision with each other by being simultaneously dispensed according to the droplet mixing method of the first exemplary embodiment of the present invention.

Referring to FIG. 4, the first and second solenoid valves 21 and 22 may be controlled such that they are simultaneously opened, after which the first solenoid valve 21 is first closed and then the second solenoid valve 22 is subsequently closed.

Since the first and second solenoid valves 21 and 23 are applied with an identical driving voltage but controlled such that opening durations T1 and T2 thereof are different from each other (T1<T2), the mixed liquid LQ3 contains the first liquid LQ1 and the second liquid LQ2, wherein an amount of the second liquid LQ2 is greater than that of the first liquid LQ1 (LQ1<LQ2). That is, FIG. 4 shows that, in the mixed liquid LQ3, the first and second liquids LQ1 and LQ2 can be mixed with each other in a ratio other than 1:1.

Figure 5:
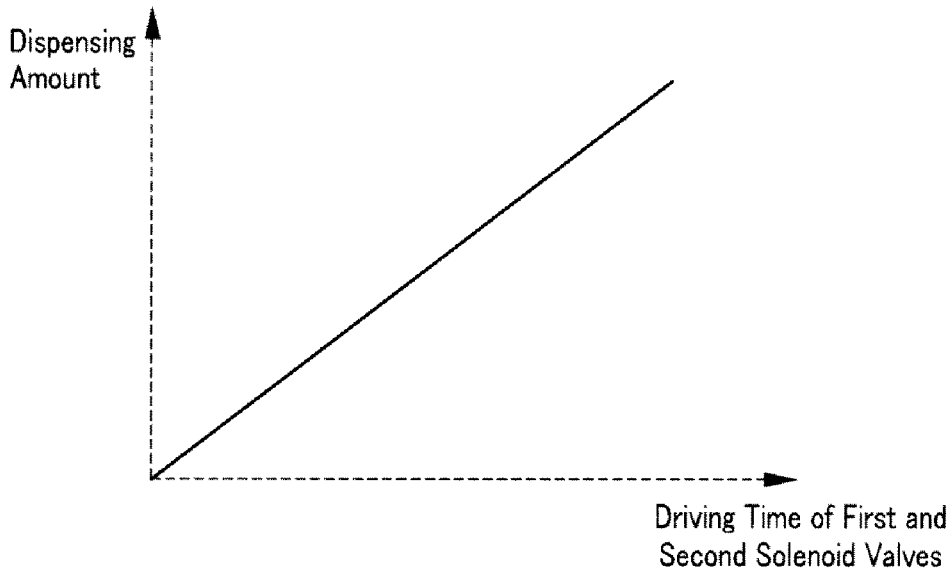
FIG. 5 is a graph illustrating a relationship between a driving time of a solenoid valve and a dispensing amount when gas pressure is uniformly maintained.
Figure 6:
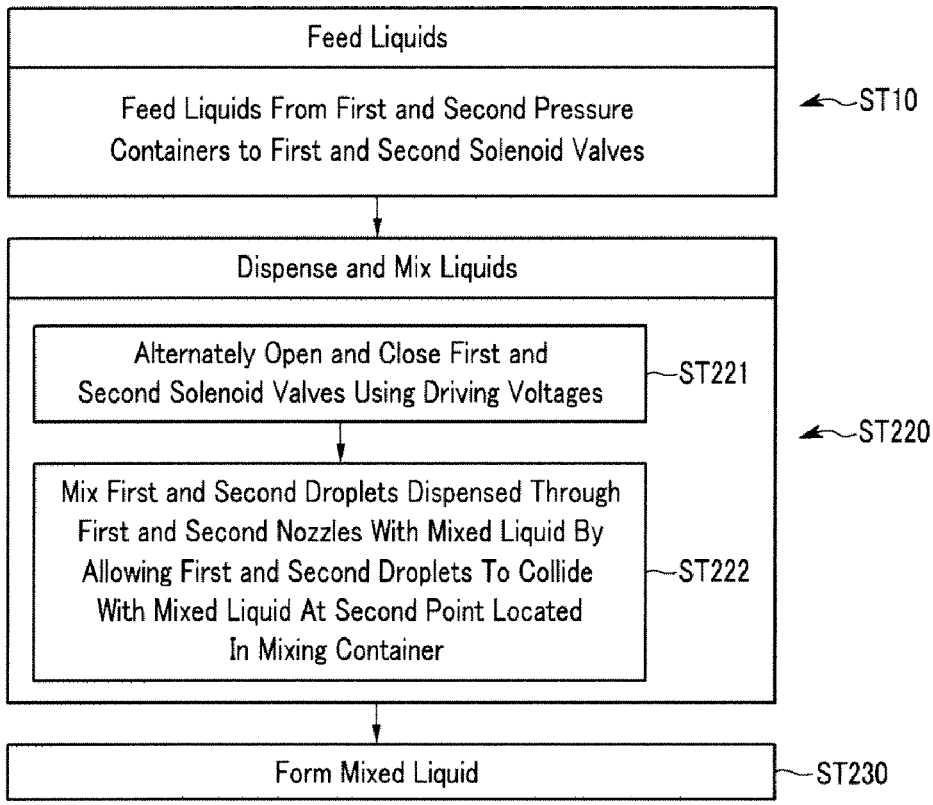
FIG. 6 is a flowchart illustrating a droplet mixing method according to a second exemplary embodiment of the present invention.

In more detail, by increasing the opening duration, the first and second solenoid valves 21 and 22 dispense larger amounts of the first and second liquids LQ1 and LQ2, respectively (see FIG. 5). On the other hand, when the opening duration is reduced, the first and second solenoid valves 21 and 22 dispense smaller amounts of the first and second liquids LQ1 and LQ2, respectively. Accordingly, in order to dispense the first and second liquids LQ1 and LQ2 in a predetermined ratio, the first and second solenoid valves 21 and 22 may be controlled such that the opening durations thereof differ from each other.

The control unit 30 generates a variety of driving signals to variously control the first and second solenoid valves 21 and 22 as described above. The control unit 30 may be formed, for example, of a control circuit that generates a variety of driving signals based on transistor-transistor logic (TTL) signals.

Figure 8:
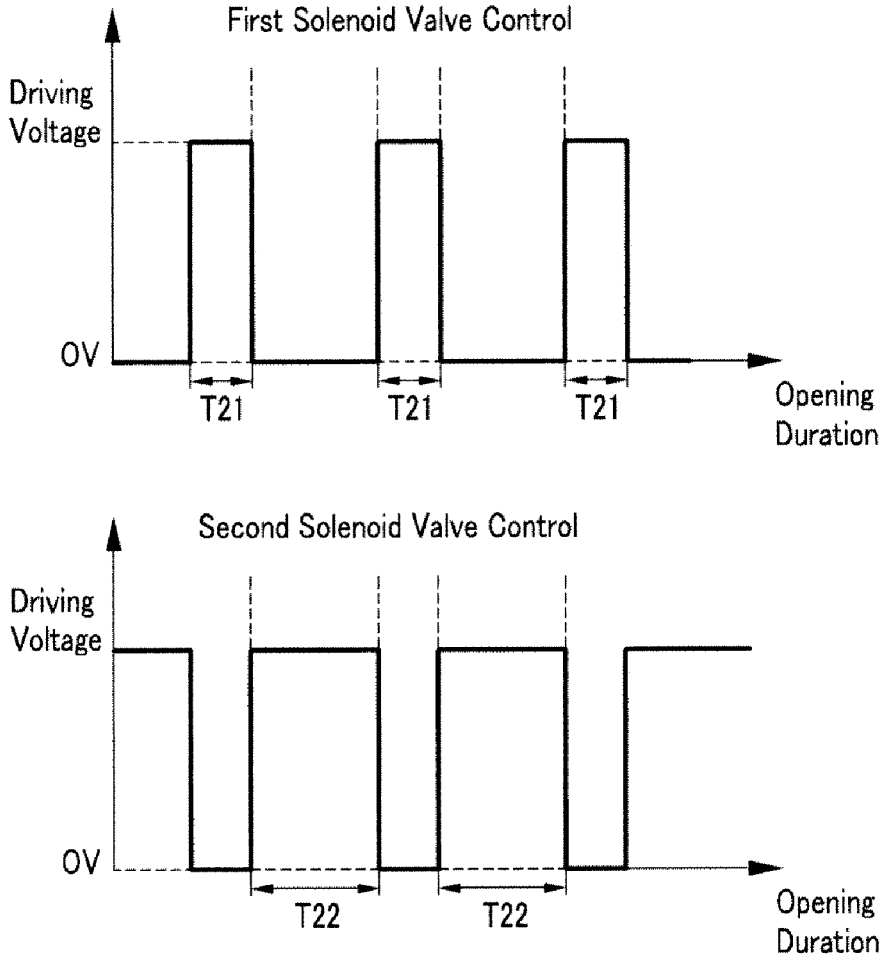
FIG. 8 is a time chart for driving solenoid valves such that droplets are mixed with each other through collision between the droplets and a multi-layered liquid by being alternately dispensed according to the droplet mixing method of the second exemplary embodiment of the present invention.
Figure 9:
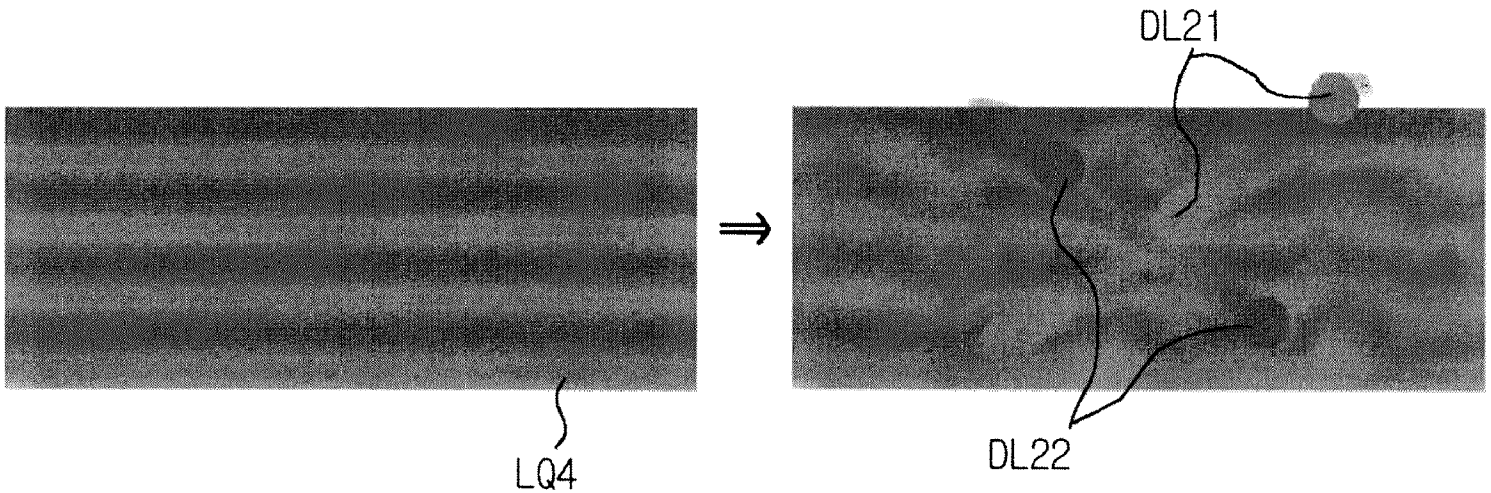
FIG. 9 illustrates views respectively before and after the multi-layered liquid is stirred by collision with droplets in the droplet mixing method of the second exemplary embodiment of the present invention.

The foregoing description with reference to FIGS. 3 and 4 is related to a droplet mixing method of a first exemplary embodiment. The following description provided with reference to FIGS. 7 to 9 is related to a droplet mixing method of a second exemplary embodiment.

Description of parts of the second exemplary embodiment that are similar or identical to those of the first exemplary embodiment will be omitted herein.

Figure 7:
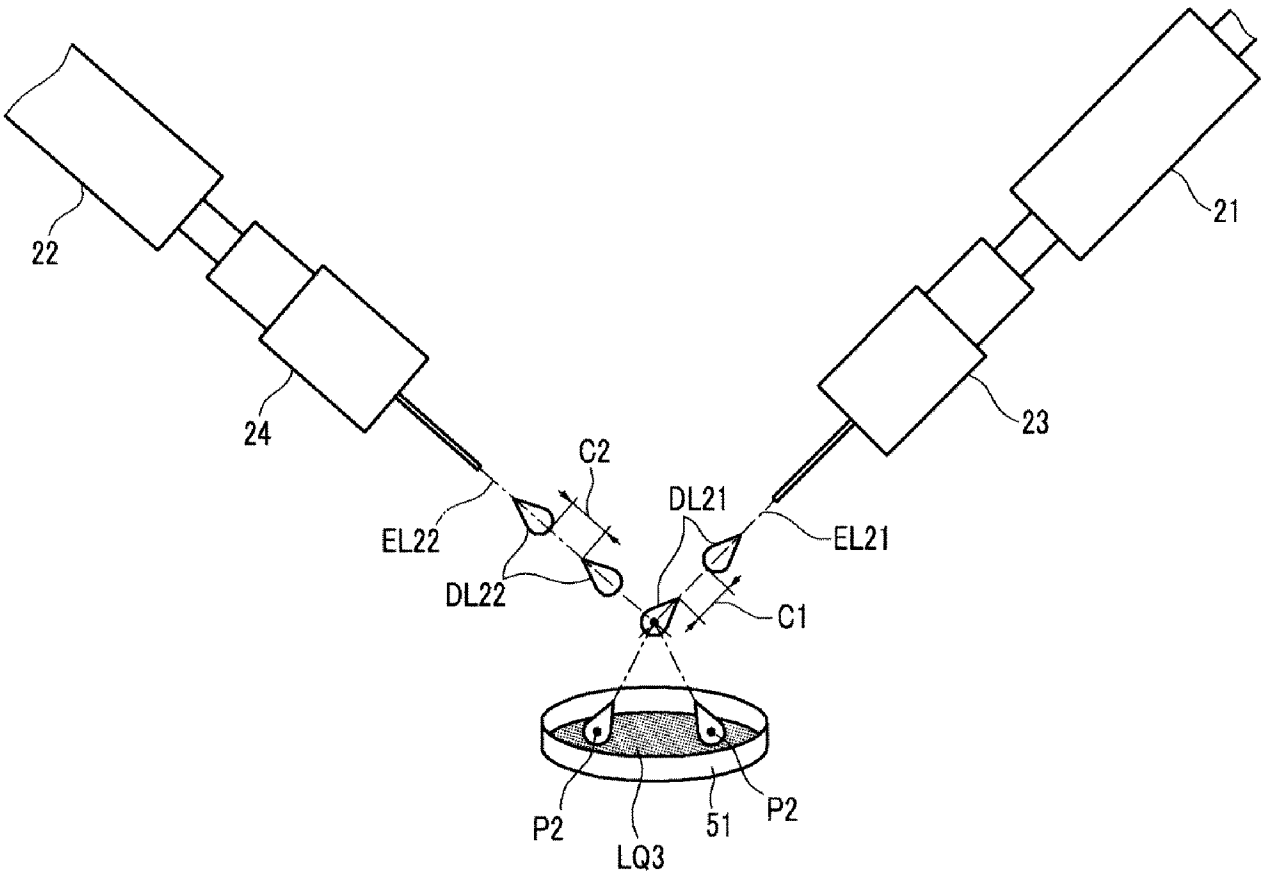
FIG. 7 is a view illustrating a state where droplets are mixed with each other through collision between the droplets and a multi-layered liquid by being alternately dispensed according to the droplet mixing method of the second exemplary embodiment of the present invention.

Referring to FIG. 7, first and second extension lines EL21 and EL22 of the respective first and second nozzles 23 and 24 meet with the mixing container 51 at second points P2. Therefore, when the first and second solenoid valves 21 and 22 are controlled to be alternately opened, first and second droplets DL21 and DL22 that are alternately dispensed through the first and second nozzles 23 and 24 alternately collide with the mixed liquid LQ3 at the second points P2, which are formed in the mixed liquid LQ3 in the mixing container 51, to thereby form the mixed liquid LQ3. The second points P2 may or may not coincide with each other in the mixing container 51 depending on an arrangement of the first and second solenoid valves 21 and 22. FIG. 7 shows the case where the second points P2 do not coincide with each other.

The first and second solenoid valves 21 and 22 may be controlled to be alternately opened and closed. Further, the first and second liquids LQ1 and LQ2 in the mixed liquid LQ3 may be mixed with each other in a ratio of 1:1.

Referring to FIG. 8, the first and second solenoid valves 21 and 22 may be controlled to be alternately opened and closed, and may be controlled such that each opening duration of the first solenoid valve 21 is less than each opening duration of the second solenoid valve 22.

Since the first and second solenoid valves 21 and 22 are applied with an identical driving voltage but controlled such that opening durations T21 and T22 thereof are different from each other (T21<T22), the mixed liquid LQ3 contains the first liquid LQ1 and the second liquid LQ2, wherein an amount of the second liquid LQ2 is greater than that of the first liquid LQ1 (LQ1<LQ2). That is, FIG. 8 shows that, in the mixed liquid LQ3, the first and second liquids LQ1 and LQ2 can be mixed with each other in a ratio other than 1:1.

In addition, FIG. 9 illustrates views respectively before and after a multi-layered liquid LQ4 is stirred by collision with the first and second droplets DL21 and DL22 when the first and second liquids LQ1 and LQ2 are alternately dispensed through the first and second solenoid valves 21 and 22.

Hence, due to the first and second droplets (DL21, DL22) stirring the multi-layered liquid LQ4 while colliding with the same, the mixed liquid LQ3 is formed.

The following will describe the droplet mixing method of the first exemplary embodiment in more detail with reference to FIGS. 1 to 4.

Referring to FIGS. 1 to 4, the droplet mixing method of the first exemplary embodiment includes steps ST10, ST20, and ST30.

In step ST10, the first and second liquids LQ1 and LQ2 stored in the respective first and second pressure containers 11 and 12 are respectively directed to the first and second solenoid valves 21 and 22.

In step ST20, the first and second liquids LQ1 and LQ2 are dispensed to the mixing container 51 by simultaneously opening the first and second solenoid valves 21 and 22 using predetermined driving voltages.

Step ST20 includes a step ST21 of controlling the first and second solenoid valves 21 and 22 using the predetermined driving voltages, a step ST22 of mixing the first and second droplets DL1 and DL2 by allowing the first and second droplets DL1 and DL2 to collide with each other at the first point P1 above the mixing container 51, and a step ST23 of forming the third mixed droplets DL3 using the first and second droplets DL1 and DL21 that are mixed with each other by the collision (see FIG. 3).

In step ST21, the first and second solenoid valves 21 and 22 are controlled to be simultaneously opened. In step ST21, the first and second solenoid valves 21 and 22 may be controlled to be closed simultaneously (T1=T2) or one after the other (T1<T2). When the first and second solenoid valves 21 and 22 are controlled to be closed simultaneously (T1=T2), the mixture ratio will be 1:1. When the first and second valves 21 and 22 are controlled to be closed one after the other (T1<T2), the mixture ratio will be other than 1:1.

Accordingly, step ST21 may include a step for making a mixture ratio of the first and second liquids LQ1 and LQ2 of the mixed liquid LQ3 be other than 1:1 by closing the first and second solenoid valves 21 and 22 one after the other.

In step ST22, the first and second droplets DL1 and DL2 of the respective first and second liquids LQ1 and LQ2 that are respectively dispensed through the first and second solenoid nozzles 23 and 24 provided on respective extreme ends of the solenoid valves 21 and 22 are mixed with each other at the first point P1 above the mixing container 51.

In step ST23, the third mixed droplets DL3 are formed by the first and second droplets DL1 and DL2 that are mixed with each other by the collision.

In step ST30, the third mixed droplets DL3 fall to the mixing container 51 to form the mixed liquid LQ3 having a predetermined mixture ratio.

The following will describe the droplet mixing method according to the second exemplary embodiment in more detail with reference to FIGS. 1 and 6 to 8. Referring to FIGS. 1 and 6 to 8, the droplet mixing method of the second exemplary embodiment is similar to that of the first exemplary embodiment. Therefore, a description of the similar or identical steps will be omitted herein.

The droplet mixing method of the second exemplary embodiment includes steps ST10, ST220, and ST230.

In step ST220, the first and second liquids LQ1 and LQ2 are dispensed to the mixing container 51. At this point, the first and second solenoid valves 21 and 22 that are respectively connected to the first and second pressure containers 11 and 12 are controlled to be alternately opened and closed by predetermined driving voltages.

Step ST220 includes a step ST221 of controlling the first and second solenoid valves 21 and 22 using the predetermined driving voltages and a step ST222 of allowing the first and second droplets DL21 and DL22 of the respective liquids LQ1 and LQ2 to alternately collide with the mixed liquid LQ3 at the second points P2 formed in the mixed liquid LQ3 (see FIG. 7).

In step ST221, the first and second solenoid valves 21 and 22 are alternately opened and closed by the predetermined driving voltages. In step ST221, the opening durations T21 and T22 of the respective first and second solenoid valves 21 and 22 may differ from each other (see FIG. 8). When the opening durations T21 and T22 are identical to each other, the mixture ratio becomes 1:1. When the opening durations T21 and T22 are different from each other, the mixture ratio becomes other than 1:1.

Accordingly, step ST221 may include a step of making the mixture ratio of the first and second liquids LQ1 and LQ2 of the mixed liquid LQ3 be other than 1:1 by differing the opening durations of the first and second solenoid valves 21 and 22 from each other.

The opening durations T21 and T22 of the respective first and second solenoid valves 21 and 22 determine sizes of the droplets and intervals C1 and C2 between the droplets that are successively dispensed. The sizes and intervals determine the mixture ratio (see FIG. 7).

In step ST222, the first and second droplets DL21 and DL22 of the respective first and second liquids LQ1 and LQ2 that are respectively dispensed through the first and second solenoid nozzles 23 and 24 provided on respective extreme ends of the solenoid valves 21 and 22 are mixed with the mixed liquid LQ3 in the mixing container 51 while alternately colliding with the mixed liquid LQ3.

In step ST230, the mixed liquid LQ3 having a predetermined mixture ratio is formed by the first and second droplets DL21 and DL22 falling into the mixing container 51.

Figure 10:
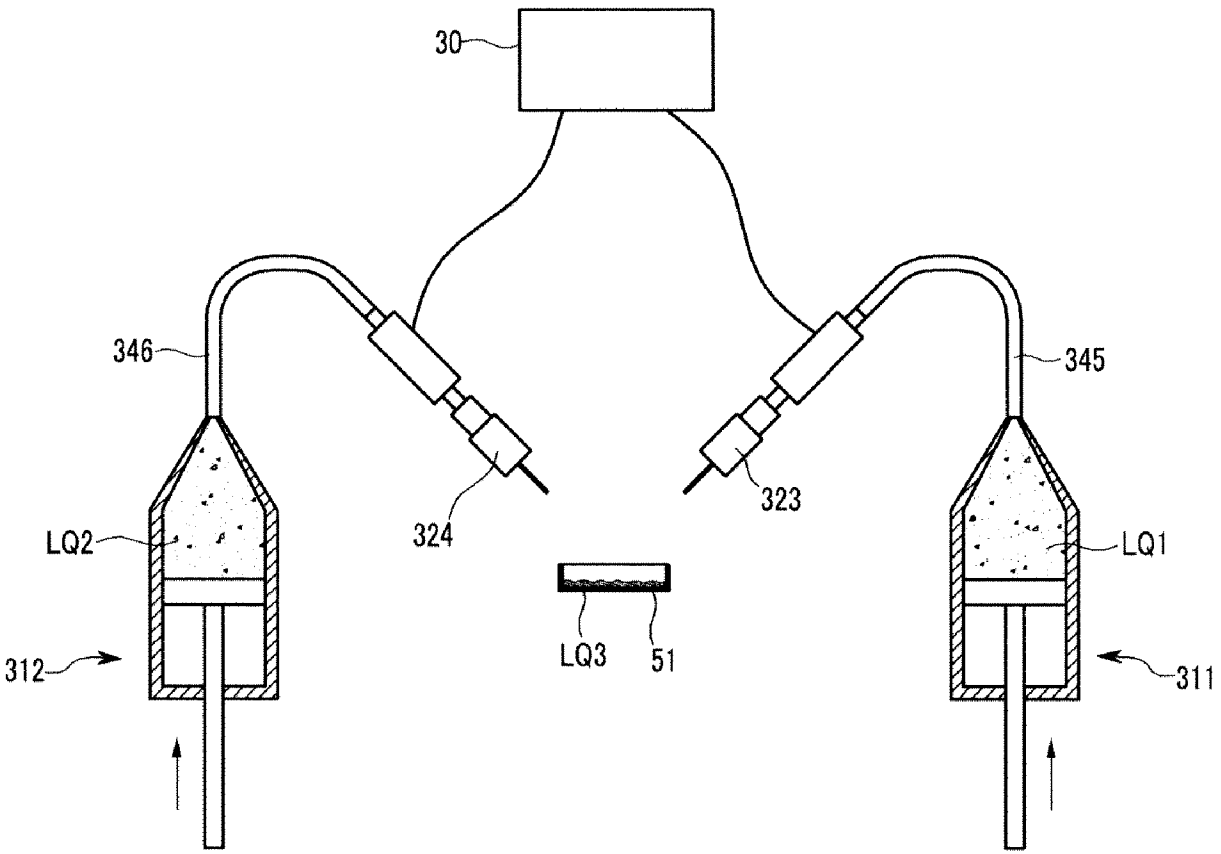
FIG. 10 is a schematic diagram of a droplet mixing apparatus according to a second exemplary embodiment of the present invention.

FIG. 10 is a schematic diagram of a droplet mixing apparatus according to a second exemplary embodiment of the present invention. The droplet mixing apparatus of the second exemplary embodiment is similar to that of the first exemplary embodiment. Therefore, a description of identical or similar parts will be omitted herein and only different parts will be described.

The droplet mixing apparatus of the second exemplary embodiment includes a plurality of dispensers (e.g., first and second dispensers 311 and 312), a plurality of inkjet nozzles (e.g., first and second inkjet nozzles 323 and 324), and a control unit 30.

The first and second dispensers 311 and 312 respectively store first and second liquids LQ1 and LQ2 and feed the first and second liquids LQ1 and LQ2 to the first and second inkjet nozzles 323 and 324, respectively.

The first and second dispensers 311 and 312 are respectively connected to the first and second inkjet nozzles 323 and 324 through respective third and fourth lines 345 and 346. Therefore, the first and second liquids LQ1 and LQ2 are respectively fed to the first and second nozzles 323 and 324 by the operation of the first and second dispensers 311 and 312. For example, the first and second dispensers 311 and 312 may be configured as syringes.

Figure 11:
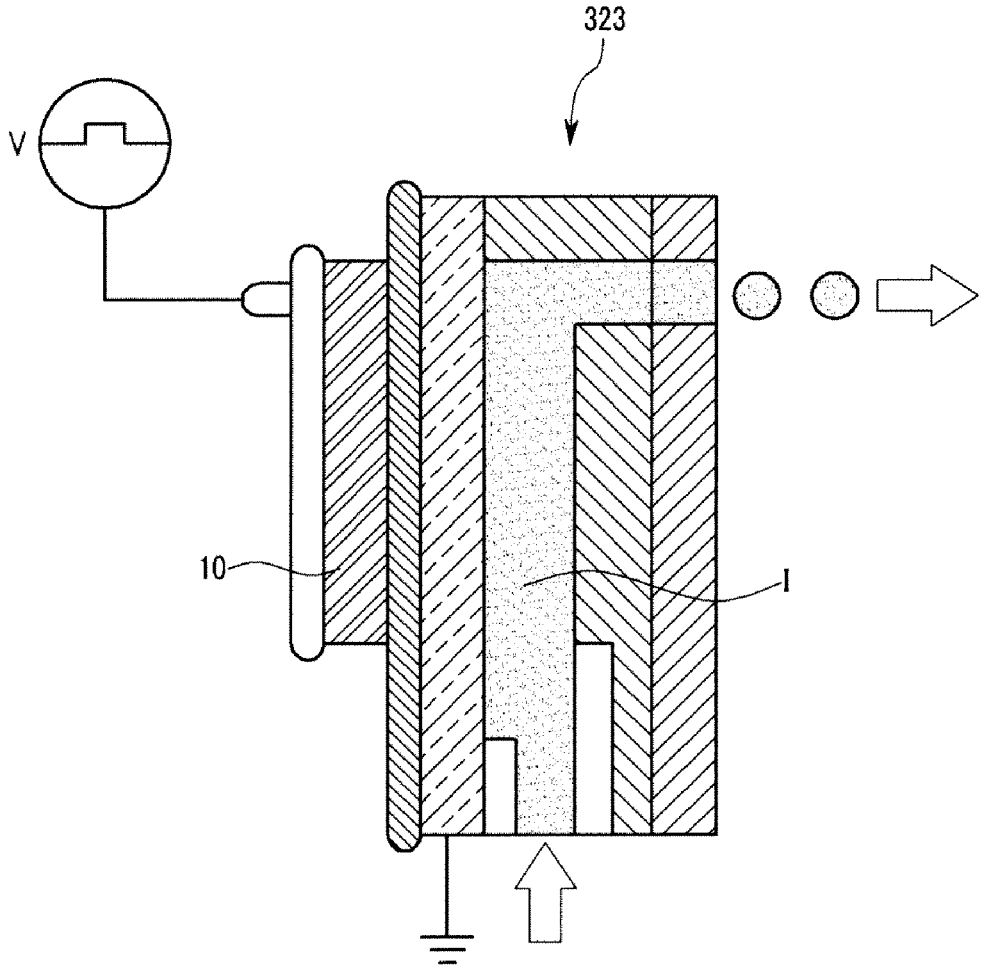
FIG. 11 is a schematic cross-sectional view of a piezoelectric-type inkjet nozzle.
Figure 12:
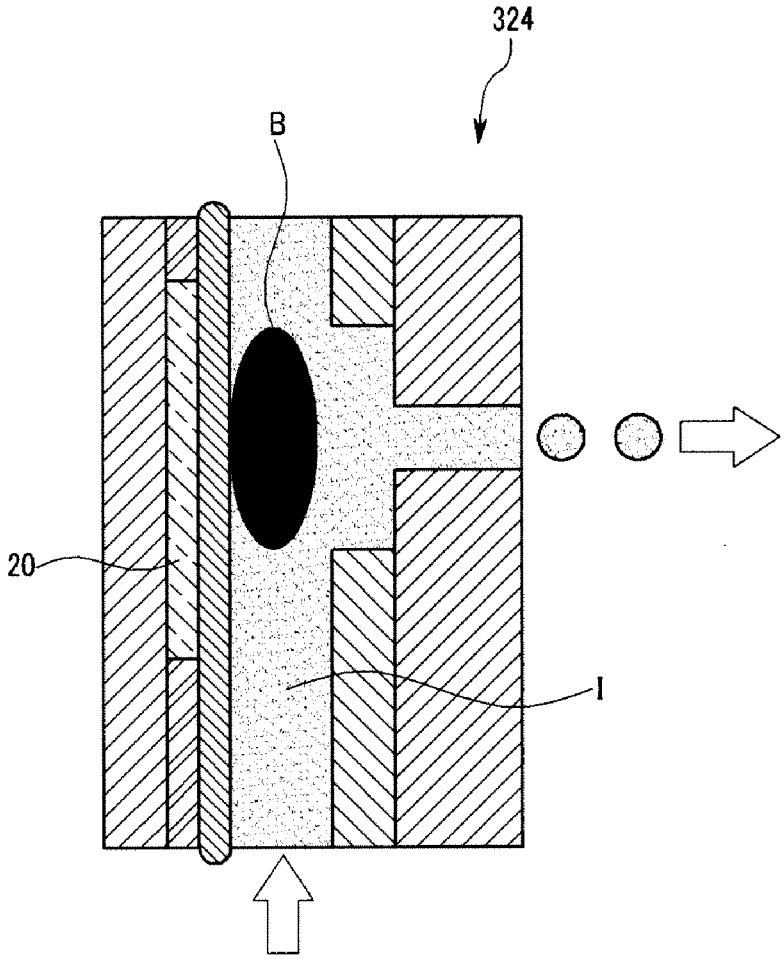
FIG. 12 is a schematic cross-sectional view of a thermal-type inkjet nozzle.
Figure 13:
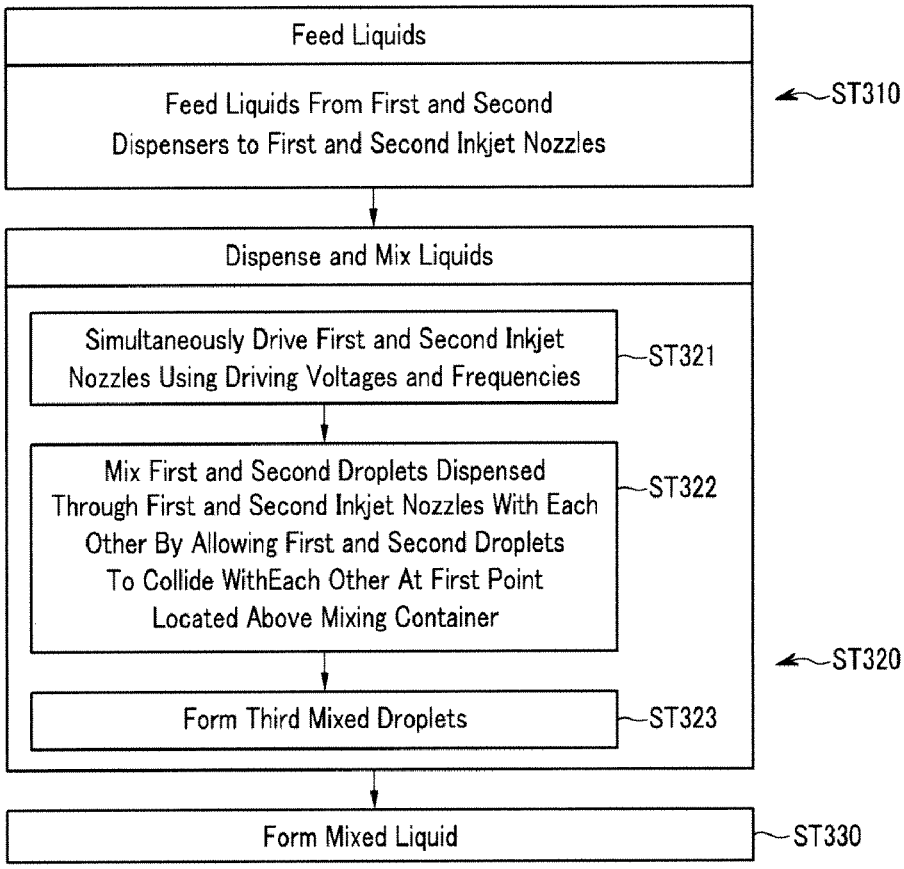
FIG. 13 is a flowchart illustrating a droplet mixing method according to a third exemplary embodiment of the present invention.

The first and second inkjet nozzles 323 and 324 may be formed as piezoelectric-type nozzles as shown in FIG. 11 or as thermal-type nozzles as shown in FIG. 12.

The first and second inkjet nozzles 323 and 324 will be described in more detail with reference to FIGS. 11 and 12. For convenience, it is assumed that the first inkjet nozzle 323 is formed as a piezoelectric-type nozzle and the second inkjet nozzle 324 is formed as a thermal-type nozzle.

FIG. 11 shows the piezoelectric-type inkjet nozzle 323. The piezoelectric-type inkjet nozzle 323 is configured to push out ink (I) using pressure generated by a piezo-element 10. FIG. 12 shows the thermal-type inkjet nozzle 324. The thermal-type inkjet nozzle 324 is configured to push out ink (I) using heat generated by a heater 20.

Each of the first and second inkjet nozzles 323 and 324, which respectively use the piezo-element 10 and the heater 20, can dispense ink droplets one at a time in a minimum amount in units of pl to a maximum amount in units of nl. Since the first and second inkjet nozzles 323 and 324 can react at a maximum of tens of kHz, they may have a dispensing speed of several μl/s. This dispensing speed is less than the dispensing speeds of the solenoid valve and the syringe. However, since a droplet dispensing amount is less than the droplet dispensing amounts of the solenoid and the syringe, the first and second liquids LQ1 and LQ2 can be more effectively mixed as they have smaller droplets.

The first and second inkjet nozzles 323 and 324 are oriented toward a mixing container 51. The mixing container 51 stores a mixed liquid LQ3 that is a mixture of the first and second liquids LQ1 and LQ2. That is, the first and second solenoid nozzles 323 and 324 are disposed above the mixing container 51 in an inclined state. Therefore, the first inkjet nozzle 323 forms a first extension line EL31 and the second inkjet nozzle 324 forms a second extension line EL32 (see FIG. 14).

The first and second inkjet nozzles 323 and 324 are disposed opposing each other above the mixing container 51. Therefore, first droplets DL31 and second droplets DL32 (see FIG. 14) of the respective first and second liquids LQ1 and LQ2 that are respectively dispensed through the first and second inkjet nozzles 323 and 324 can be more uniformly mixed with each other.

Figure 14:
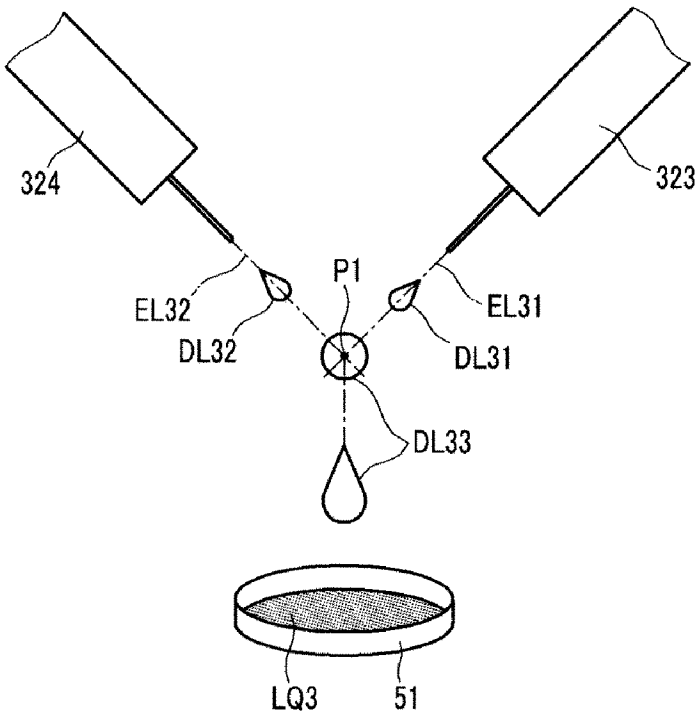
FIG. 14 is a view illustrating a state where droplets are mixed through collision with each other by being simultaneously dispensed according to the droplet mixing method of the third exemplary embodiment of the present invention.

Referring to FIG. 14, the first and second extension lines EL31 and EL32 of the respective first and second inkjet nozzles 323 and 324 meet each other at a first point P1 formed directly above the mixing container 51. Accordingly, when the first and second inkjet nozzles 321 and 322 are controlled to be simultaneously opened, the first droplets DL31 and the second droplets DL32 that are respectively dispensed through the first and second inkjet nozzles 323 and 324 collide with each other at the first point P1 to form third mixed droplets DL33.

By kinetic energy generated by the collision between the droplets, the first and second droplets DL31 and DL32 are mixed with each other while forming the third mixed droplets DL33. Subsequently, the third mixed droplets DL33 fall to the mixing container 51 by gravity so that mixing is secondarily realized to thereby form the mixed liquid LQ3.

The first and second inkjet nozzles 323 and 324 may be controlled to be simultaneously driven by identical driving voltages (V1=V2) and identical frequencies. In this case, the first and second liquids LQ1 and LQ2 form the mixed liquid LQ3 in such a manner that the first and second liquids LQ1 and LQ2 are mixed with each other in a ratio of 1:1.

Figure 15:
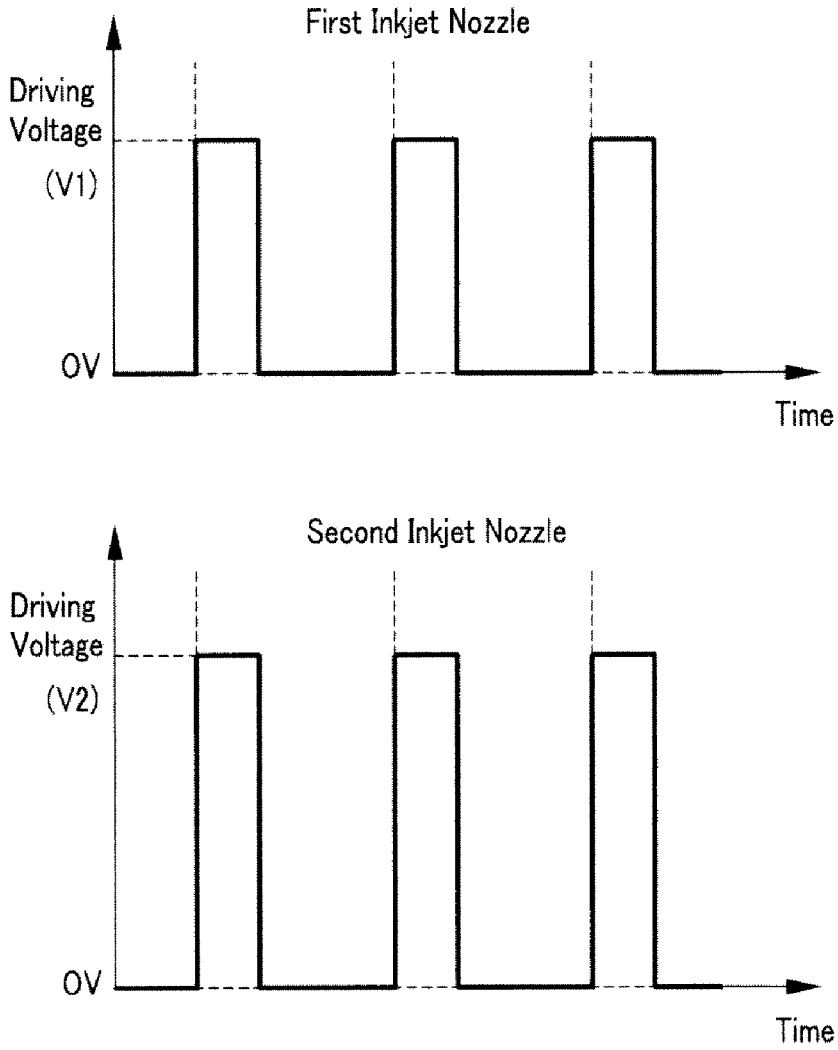
FIG. 15 is a time chart for driving inkjet nozzles such that droplets are mixed through collision with each other by being simultaneously dispensed according to the droplet mixing method of the third exemplary embodiment of the present invention.
Figure 16:
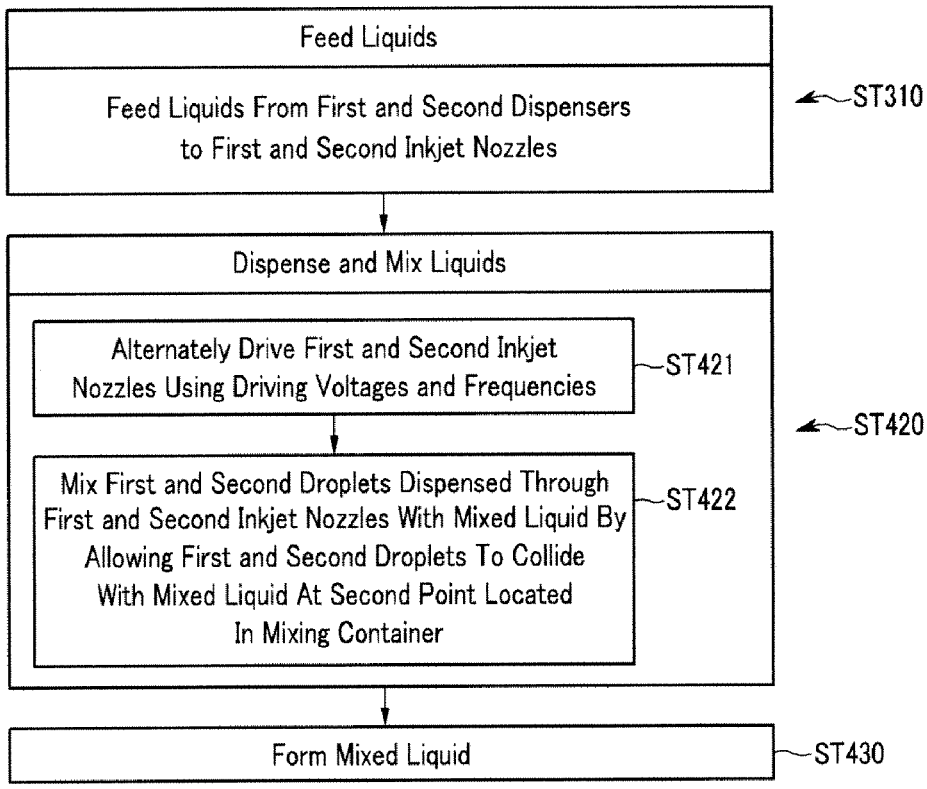
FIG. 16 is a flowchart illustrating a droplet mixing method according to a fourth exemplary embodiment of the present invention.

Referring to FIG. 15, the first and second inkjet nozzles 323 and 324 may be controlled to be simultaneously driven but the driving voltages V1 and V2 may be different from each other (V1<V2). By the difference (V1<V2) of the driving voltages, a variation in the volume of a piezo-material changes. For example, in the thermal-type inkjet nozzle, a size of each bubble (B of FIG. 12) generated varies. In the mixed liquid LQ3, an amount of the first liquid LQ1 is less than that of the second liquid LQ2 (LQ1<LQ2). That is, as shown in FIG. 15, in the mixed liquid LQ3, the first and second liquids LQ1 and LQ2 can be mixed with each other in a ratio other than 1:1. Further, the first and second inkjet nozzles 323 and 324 using the piezo-material can form the mixed liquid LQ3 containing the first and second liquids LQ1 and LQ2 whose mixture ratio is other than 1:1.

The foregoing description with reference to FIGS. 14 and 15 is related to a droplet mixing method of a third exemplary embodiment. The following description with reference to FIGS. 17 and 18 is related to a droplet mixing method of a fourth exemplary embodiment.

Figure 17:
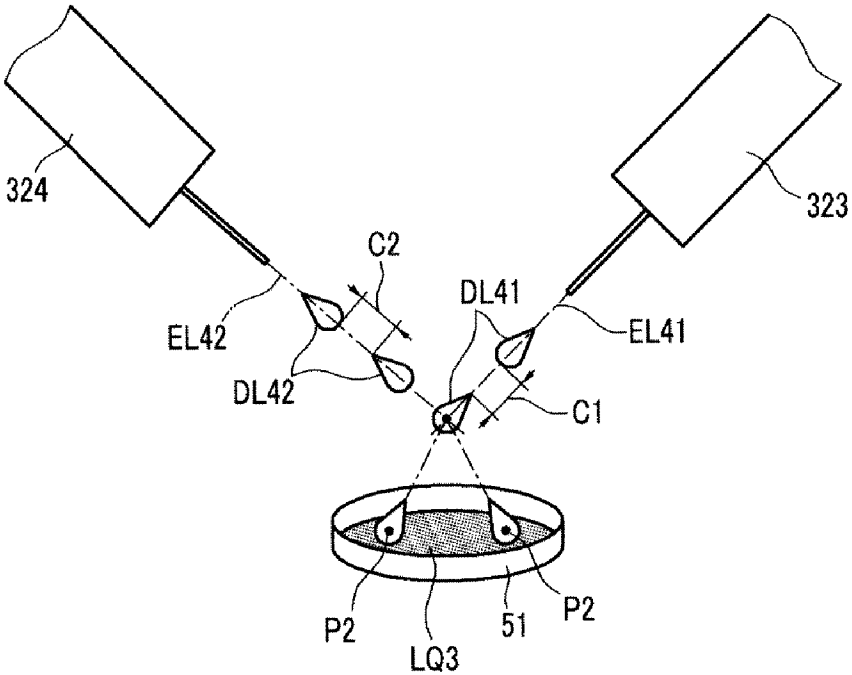
FIG. 17 is a view illustrating a state where droplets are mixed with each other through collision between the droplets and a multi-layered liquid by being alternately dispensed according to the droplet mixing method of the fourth exemplary embodiment of the present invention.

Referring to FIG. 17, first and second extension lines EL41 and EL42 of respective first and second inkjet nozzles 323 and 324 meet with the mixing container 51 at second points P2. Therefore, when the first and second inkjet nozzles 323 and 324 are controlled to be alternately opened, first and second droplets DL41 and DL42 that are alternately dispensed through the first and second inkjet nozzles 323 and 324 alternately collide with a mixed liquid LQ3 at second points P2 formed in the mixed liquid LQ3 in the mixing container 51 to thereby form the mixed liquid LQ3. The first and second liquids LQ1 and LQ2 in the mixed liquid LQ3 may be mixed with each other in a ratio of 1:1.

When the first and second inkjet nozzles 323 and 324 are controlled to be simultaneously driven by identical driving voltages (V1=V2) and identical frequencies, the first and second liquids LQ1 and LQ2 in the mixed liquid LQ3 can be mixed with each other in a ratio of 1:1.

Figure 18:
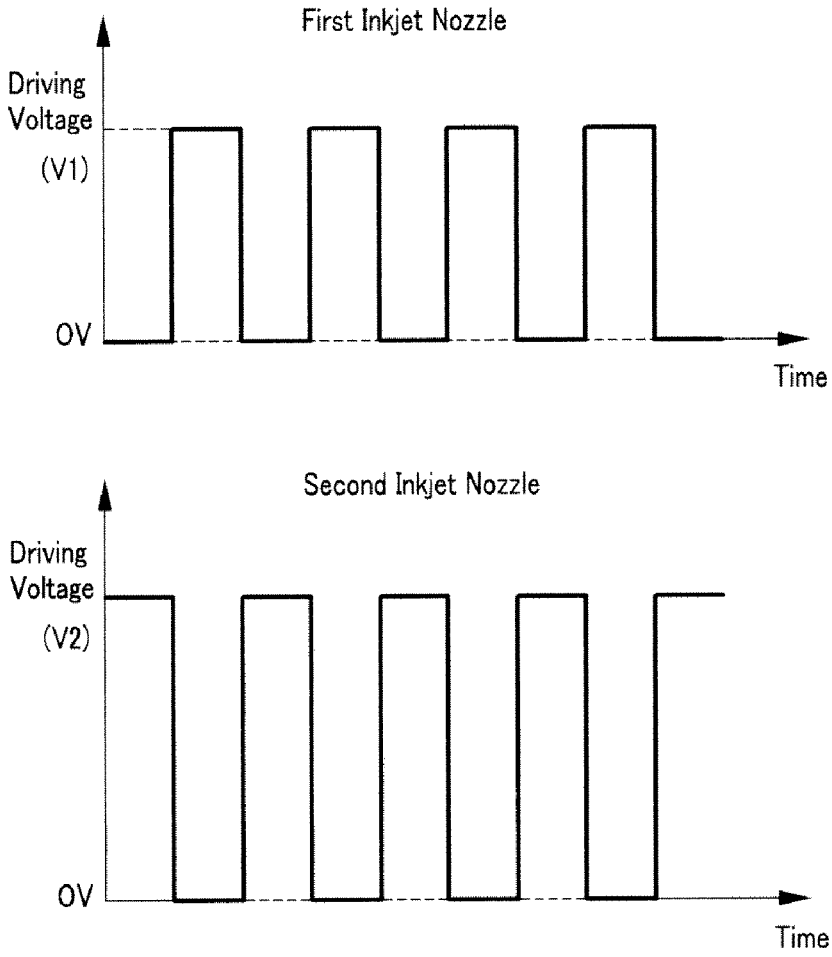
FIG. 18 is a time chart for driving inkjet nozzles such that droplets are mixed with each other through collision between the droplets and a multi-layered liquid by being alternately dispensed according to the droplet mixing method of the fourth exemplary embodiment of the present invention.

Referring to FIG. 18, the first and second inkjet nozzles 323 and 324 may be controlled to be simultaneously driven, and a driving voltage V1 of the first inkjet nozzle 323 may be less than a driving voltage V2 of the second inkjet nozzle 324.

That is, the first and second inkjet nozzles 323 and 324 may be controlled to be simultaneously driven and the driving voltages V1 and V2 may be different from each other (V1<V2). In the mixed liquid LQ3, the amount of the first liquid LQ1 is less than that of the second liquid LQ2 (LQ1<LQ2). That is, FIG. 18 shows that, in the mixed liquid LQ3, the first and second liquids LQ1 and LQ2 can be mixed with each other in a ratio other than 1:1.

The following will describe the droplet mixing method of the third exemplary embodiment in more detail with reference to FIGS. 10 and 13 to 15.

Referring to FIGS. 10 and 13 to 15, the droplet mixing method of the third exemplary embodiment includes steps ST310, ST320, and ST330.

In step ST310, the first and second liquids LQ1 and LQ2 stored in the respective first and second dispensers 311 and 312 are respectively directed to the first and second inkjet nozzles 323 and 324.

In step ST310, the first and second liquids LQ1 and LQ2 are fed to the first and second inkjet nozzles 323 and 324 by use of pressure or a capillary phenomenon of the first and second dispensers 311 and 312.

In step ST320, the first and second liquids LQ1 and LQ2 are dispensed to the mixing container 51 by simultaneously driving the first and second inkjet nozzles 323 and 324 that are respectively connected to the first and second dispensers 311 and 312 using predetermined driving voltages V1 and V2 and frequencies.

Step ST320 includes a step ST321 of simultaneously driving the first and second inkjet nozzles 323 and 324 using the predetermined driving voltages and frequencies, a step ST322 of mixing the first and second droplets DL31 and DL32 of the first and second liquids LQ1 and LQ2 by allowing the first and second droplets DL31 and DL32 to collide with each at the first point P1 above the mixing container 51, and a step ST323 of forming the third mixed droplets DL33 using the first and second droplets DL1 and DL21 that are mixed with each other by the collision (see FIG. 14).

In step ST321, the first and second inkjet nozzles 323 and 324 are controlled to be simultaneously driven. When the driving voltages V1 and V2 are identical to each other and the frequencies are identical to each other, the mixture ratio will be 1:1. When the driving voltages V1 and V2 are different from each other, the mixture ratio will be other than 1:1. When inkjet nozzles that differ in a droplet dispensing amount from each other are used (e.g., when inkjet nozzles having materials that differ in a volume variation from each other are used), a mixture ratio of the liquids in the mixed liquid will also be other than 1:1. Accordingly, step ST321 may include a step for making a mixture ratio of the first and second liquids LQ1 and LQ2 of the mixed liquid LQ3 be other than 1:1 by utilizing the above-described method.

In step ST322, the first and second droplets DL31 and DL32 of the respective first and second liquids LQ1 and LQ2 that are respectively dispensed through the first and second inkjet nozzles 323 and 324 are mixed with each other at the first point P1 above the mixing container 51.

In step ST323, the third mixed droplets DL33 are formed by the first and second droplets DL31 and DL32 that are mixed with each other by the collision.

In step ST330, the third mixed droplets DL33 fall to the mixing container 51 to form the mixed liquid LQ3 having a predetermined mixture ratio. As the droplets DL33 fall to collide with the mixed liquid LQ3, the mixing performance is enhanced.

The following will describe the droplet mixing method according to the second exemplary embodiment in more detail with reference to FIGS. 10 and 16 to 18. Referring to FIGS. 10 and 16 to 18, the droplet mixing method of the fourth exemplary embodiment is similar to that of the third exemplary embodiment. Therefore, a description of similar or identical steps will be omitted herein.

The droplet mixing method of the fourth exemplary embodiment includes steps ST310, ST420, and ST430.

In step ST420, the first and second liquids LQ1 and LQ2 are dispensed to the mixing container 51 by alternately driving the first and second inkjet nozzles 323 and 324 using predetermined driving voltages V1 and V2 and frequencies.

Step ST420 includes a step ST421 of controlling the first and second inkjet nozzles 323 and 324 using the predetermined driving voltages V1 and V2 and frequencies, and a step ST422 of allowing the first and second droplets DL41 and DL42 of the respective liquids LQ1 and LQ2 to alternately collide with the mixed liquid LQ3 at the second points P2 formed in the mixed liquid LQ3 (see FIG. 17).

In step ST421, the first and second inkjet nozzles 323 and 324 are alternately driven by the predetermined driving voltages and frequencies. When the driving voltages V1 and V2 are identical to each other and the frequencies are identical to each other, the mixture ratio will be 1:1. When the driving voltages V1 and V2 are different from each other, the mixture ratio will be other than 1:1. Accordingly, step ST421 may include a step for making a mixture ratio of the first and second liquids LQ1 and LQ2 of the mixed liquid LQ3 be other than 1:1 by utilizing the above-described method.

In step ST422, the first and second droplets DL41 and DL42 of the respective first and second liquids LQ1 and LQ2 that are respectively dispensed through the first and second inkjet nozzles 323 and 324 are mixed with the mixed liquid LQ3 in the mixing container 51 while alternately colliding with the mixed liquid LQ3 (see FIG. 9).

In step ST430, the mixed liquid LQ3 having a predetermined mixture ratio is formed by the first and second droplets DL41 and DL42 dispensed alternately and falling into the mixing container 51.

The following will briefly describe the driving voltages and frequencies that are used for controlling the driving of the first and second inkjet nozzles 323 and 324. FIG. 15 shows by way of example the situation in which the driving voltages are different from each other while the frequencies are identical to each other for the third exemplary embodiment. FIG. 18 shows by way of example the situation in which the driving voltages are different from each other while the frequencies are identical to each other for the fourth exemplary embodiment. When comparing the embodiment of FIG. 15 with the embodiment of FIG. 18, it can be noted that they differ in driving voltage and frequency.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A droplet mixing apparatus comprising:

a plurality of pressure containers storing liquids that are to be dispensed;

a plurality of solenoid valves that are respectively connected to the pressure containers to dispense the liquids fed from the pressure containers into a mixing container; and a control unit that controls the solenoid valves such that the solenoid valves are either simultaneously opened or alternately opened and closed, wherein each of the solenoid valves is provided at an extreme end with a nozzle, and the nozzles are disposed above the mixing container in an inclined state.

2. The droplet mixing apparatus of claim 1, wherein the solenoid valves include a first solenoid valve disposed above a first side of the mixing container and a second solenoid valve disposed opposing the first solenoid valve above a second side of the mixing container.

3. The droplet mixing apparatus of claim 2, wherein a first straight line extending from a first nozzle provided on the first solenoid valve and a second straight line extending from a second nozzle provided on the second solenoid valve meet each other at a point located directly above the mixing container.

4. The droplet mixing apparatus of claim 2, wherein a first straight line extending from a first nozzle provided on the first solenoid valve and a second straight line extending from a second nozzle provided on the second solenoid valve meet with a mixed liquid at points located in the mixing container.

5. The droplet mixing apparatus of claim 2, further comprising pressure regulators that are respectively connected to the pressure containers and air compressors that are respectively connected to the pressure regulators.

6. A droplet mixing method comprising:

feeding liquids respectively stored in a plurality of pressure containers to respective solenoid valves; and controlling the solenoid valves such that the solenoid valves are either simultaneously opened or alternately opened and closed to dispense the liquids into a mixing container, wherein controlling the solenoid valves comprises mixing droplets of the liquids dispensed through nozzles of the respective solenoid valves with each other by allowing the droplets to collide with each other at a point above or in the mixing container.

7. The droplet mixing method of claim 6, wherein:

the liquids include a first liquid and a second liquid;

the solenoid valves include a first solenoid valve for dispensing the first liquid and a second solenoid valve for dispensing the second liquid; and the first and second solenoid valves are respectively provided at respective extreme ends with first and second nozzles, wherein, the controlling of the solenoid valves includes simultaneously opening the first and second solenoid valves, and the mixing of the droplets includes mixing first and second droplets of the respective first and second liquids dispensed through the respective first and second nozzles of the respective first and second solenoid valves with each other by allowing the first and second droplets to collide with each other at a point above the mixing container.

8. The droplet mixing method of claim 7, wherein the controlling of the solenoid valves includes determining a mixture ratio of a mixed liquid formed by the first and second liquids by closing the first and second solenoid valves one after the other.

9. The droplet mixing method of claim 6, wherein:

the liquids include a first liquid and a second liquid;

the solenoid valves include a first solenoid valve for dispensing the first liquid and a second solenoid valve for dispensing the second liquid; and the first and second solenoid valves are respectively provided at respective extreme ends with first and second nozzles, wherein, the controlling of the solenoid valves includes alternately opening the first and second solenoid valves, and the mixing of the droplets includes mixing first and second droplets of the respective first and second liquids dispensed through the respective first and second nozzles of the respective first and second solenoid valves with a mixed liquid in the container by allowing the first and second droplets to alternately collide with the mixed liquid.

10. The droplet mixing method of claim 9, wherein the controlling of the solenoid valves includes determining a mixture ratio of the mixed liquid formed by the first and second liquids by closing the first and second solenoid valves one after the other.

11. A droplet mixing apparatus comprising:

a plurality of dispensers for storing and feeding respective liquids;

a plurality of inkjet nozzles that are respectively connected to the dispensers to dispense the liquids fed from the respective dispensers into a mixing container, wherein each of the plurality of inkjet nozzles is formed as a piezoelectric-type nozzle or thermal-type nozzle; and a control unit that controls the inkjet nozzles such that the inkjet nozzles are simultaneously or alternately driven, wherein the inkjet nozzles are disposed above the mixing container in an inclined state and include a first inkjet nozzle disposed above a first side of the mixing container and a second inkjet nozzle disposed opposing the first inkjet nozzle above a second side of the mixing container and a first straight line extending from the first inkjet nozzle and a second straight line extending from the second inkjet nozzle meet with a mixed liquid at point located in the mixing container.

12. A droplet mixing method comprising:

feeding liquids respectively stored in a plurality of dispensers to respective inkjet nozzles; and controlling the inkjet nozzles such that the inkjet nozzles are alternately driven by controlling driving voltages of the respective inkjet nozzles and frequencies of the respective inkjet nozzles to thereby dispense the liquids into a mixing container, wherein controlling the inkjet nozzles includes mixing droplets of the liquids dispensed through the respective first and second inkjet nozzles with each other by allowing the droplets to alternately collide with a mixed liquid in the mixing container.

13. The droplet mixing method of claim 12, wherein:

the liquids include a first liquid and a second liquid; and the inkjet nozzles include a first inkjet nozzle for dispensing the first liquid and a second inkjet nozzle for dispensing the second liquid, wherein the alternate driving of the inkjet nozzles includes alternately driving the first and second inkjet nozzles, and the mixing of the droplets includes mixing first and second droplets of the respective first and second liquids dispensed through the respective first and second inkjet nozzles with each other by allowing the first and second droplets to collide with a mixed liquid in the mixing container.

14. The droplet mixing method of claim 13, wherein the alternate driving of the inkjet nozzles includes determining a mixture ratio of a mixed liquid formed by the first and second liquids by differing frequencies of the driving voltages of the respective first and second inkjet nozzles.

* * * * *